US006135039A

United States Patent [19]

Tei et al.

[11] Patent Number: 6,135,039

[45] Date of Patent: Oct. 24, 2000

[54] ARCH CLAMP FOOT PRESSING DEVICE

[75] Inventors: Shihiko Tei; Kenichi Soutome, both of Utsunomiya, Japan

[73] Assignee: The Singer Company N.V., Netherlands Antilles

[21] Appl. No.: 09/103,454

[22] Filed: Jun. 24, 1998

[30] Foreign Application Priority Data

Sep. 18, 1997 [JP] Japan ..... 9-272201

[51] Int. Cl.[7] ..... D05B 29/02

[52] U.S. Cl. ..... 112/237; 112/76

[58] Field of Search ..... 112/235, 237, 112/238, 239, 240, 113, 114, 70, 76, 470.14

[56] References Cited

U.S. PATENT DOCUMENTS 1,537,155 5/1925 Allen ..... 112/70 X
3,669,043 6/1972 Nicolay ..... 112/76
4,165,699 8/1979 Nishi ..... 112/240
4,699,072 10/1987 Tsukioka ..... 112/235
5,715,766 2/1998 Numanoi ..... 112/470.14

*Primary Examiner*—Ismael Izaguirre
*Attorney, Agent, or Firm*—Cummings & Lockwood

[57] ABSTRACT

When arch clamp feet are replaced with other, set screws fastening a retaining plate are all removed, and the same set screws are fastened again to the retaining plates after the replacement of the arch clamp feet, which takes time and labor. Accordingly, the replacement of the arch clamp feet involved in the change of working process in a sewing mill, causes the deterioration of the rate of operation. A arch clamp foot pressing device is provided with a carrying unit which moves arch clamp foot lifting levers substantially horizontally along axes connecting between tip end portions and base end portions of the arch clamp foot lifting levers while it is guided by a pin, wherein the arch clamp foot lifting levers are moved in the direction of the base end portions by the carrying unit so that the tip end portions of the arch clamp foot lifting levers are disengaged from slots of arch clamp feet.

3 Claims, 11 Drawing Sheets

ARCH CLAMP FOOT PRESSING DEVICE

BACKGROUND OF THE INVENTION

1. Field of the Invention

The present invention relates to an arch clamp foot pressing device of a sewing machine, particularly to an arch clamp foot pressing device such as a bar tacking machine capable of performing automatic cycle sewing.

2. Prior Art

FIG. 15 is a schematic view of a conventional bar tacking machine comprising a workpiece clamping unit 30 which has a arch clamp frame 1 disposed on a bed 9, a workpiece clamping unit driving mechanism 40 which is disposed in the bed 9 and drives the workpiece clamping unit 30 in given directions, back and forth (right and left in FIG. 15) and right and left (vertical direction relative to the paper surface in FIG. 15), and a clamp lifting mechanism 17 which is disposed in an arm 16 for driving arch clamp feet 5 up and down. The clamp lifting mechanism 17 includes a solenoid actuator 34 having a plunger 34*a*, a guide bushing 36 attached to the arm 16, a pressing member 18 which has a flange 18*a* and the up and down movement thereof is guided by the guide bushing 36, and a transmitting mechanism 37 which transmits the protruding and entering operation of the plunger 34*a* of the solenoid actuator 34 to the pressing member 18 to cause the pressing member 18 to move up and down. The transmitting mechanism 37 comprises a pair of links which are connected to form a shape of angle, and the pressing member 18 is moved up and down by changing the amount of bending of a pair of links.

A pin 2 is fixed to the arch clamp frame 1 and an arch clamp foot lifting lever 3 is turnably supported by the pin 2. The arch clamp foot lifting lever 3 is always biased counterclockwise about the pin 2 serving as a fulcrum by an compression spring 4, and a tip end portion 3*b* is engaged in the arch clamp feet 5 which are disposed on the arch clamp frame 1 to move up and down. With the counterclockwise biasing of the turning of the arch clamp foot lifting lever 3 , the arch clamp feet 5 are lowered so that the workpiece is clamped on a feed plate 10. The feed plate 10 is formed integrally with the arch clamp frame 1.

In the bar tacking machine, the entering operation of the plunger 34*a* caused by energizing the solenoid of the solenoid actuator 34 lowers the pressing member 18 by way of the transmitting mechanism 37. Accordingly, a projection 15, and hence the base end portion of the arch clamp foot lifting lever 3 rather than the pin 2 is pressed downward by the flange 18*a* of the pressing member 18 so that the arch clamp foot lifting lever 3 is turned clockwise about the pin 2 against resiliency of the compression spring 4, and hence the arch clamp feet 5 move upward. With the upward movement of the arch clamp feet 5, a workpiece clamped between the arch clamp feet 5 and the feed plate 10 is released.

On the other hand, when the solenoid of the solenoid actuator 34 is deenergized, the pressing member 18 is moved upward by way of the transmitting mechanism 37. Consequently, the pressing member 18 comes into contact with the lower surface of the guide bushing 36 fixed to the arm 16, releasing the pressed state of the projection 15 of the pressing member 18. As a result, the arch clamp foot lifting lever 3 receiving the resiliency of the compression spring 4 is turned counterclockwise about the pin 2 to lower the arch clamp feet 5 so that the workpiece can be clamped between the arch clamp feet 5 and the feed plate 10.

The arch clamp frame 1 of the workpiece clamping unit 30 and the feed plate 10 are moved in given directions, back and forth and right and left on the upper surface of the bed 9 by the workpiece clamping unit driving mechanism 40 while the workpiece is clamped between the arch clamp feet 5 and feed plate 10, thereby subjecting the workpiece to a given bar tacking by a needle 41.

However, in the conventional arch clamp foot pressing device, the arch clamp feet 5 are vertically movably received in grooves 1*b* of the arch clamp frame 1 in the same manner as shown in FIG. 6 so that it is prevented from coming off by retaining plates 6. All the retaining plates 6 for retaining the arch clamp feet 5 from the outside are secured in given positions by set screws 8. Accordingly, when the arch clamp feet 5 are replaced with other to cope with the content of the sewing operation, all the set screws 8 fastening the retaining plates 6 are removed, then the arch clamp feet 5 are replaced with other, and thereafter the set screws 8 are again fastened, which are very troublesome. As a result, there occurs a problem that the replacing operation of the arch clamp feet 5 involved in the change of sewing operation in the sewing factory causes the deterioration of the rate of operation.

SUMMARY OF THE INVENTION

It is an object of the invention to provide an arch clamp foot pressing device capable of easily replacing an arch clamp feet 5 with other in a short time in an automatic cycle sewing machine, such as a bar tacking machine so as to quickly cope with the change of the content of sewing operation, and of improving the rate of operation of the sewing machine.

The arch clamp foot pressing device according to the first aspect of the invention comprises a bed 9, a arch clamp frame 1 which moves in given directions, back and forth and right and left, at least one arch clamp foot 5 attached to a tip end 1*a* of the arch clamp frame 1 to be movable up and down and to be extracted upward, arch clamp foot lifting levers (12, 302) which are provided corresponding to the arch clamp feet 5 and have middle portions turnably supported by the arch clamp frame 1 by a pin (13, 301), base end portions (12*a*, 302*a*) biased upward by an upward biasing means 4, and tip end portions (12*b*, 302*b*) engageable in and disengageable from slots 5*a* of the arch clamp feet 5 and a feed plate 10 which is integrated with the arch clamp frame 1, wherein the tip end portions (12*b*, 302*b*) of the arch clamp foot lifting levers (12, 302) elastically press the arch clamp feet 5 downward owing to the biasing force of the upward biasing means 4 while the tip end portions (12*b*, 302*b*) of the arch clamp foot lifting levers (12, 302) are engaged in the slots 5*a* of the arch clamp feet 5 to clamp a workpiece between the feed plate 10 and the arch clamp feet 5, characterized in further comprising a carrying unit (33, 133) which can move the arch clamp foot lifting levers (12, 302) substantially horizontally along axes connecting between the tip end portions (12*b*, 302*b*) and the base end portions 12*a*, 302*a*) of the arch clamp foot lifting levers (12, 302) while it is guided by the pin (13, 301), and wherein the tip end portions (12*b*, 302*b*) of the arch clamp foot lifting levers (12, 302) are disengaged from the slots 5*a* of the arch clamp feet 5 when the arch clamp foot lifting levers (12, 302) are moved by the carrying unit (33, 133) toward the base end portions (12*a*, 302*a*) of the arch clamp foot lifting levers (12, 302).

The arch clamp foot pressing device according to the second aspect of the invention is characterized in that the carrying unit 33 in the first aspect of the invention comprises the pin 13, and the pin 13 comprises a large diameter portion 13*b* which is turnably received in a through hole 1*e* of the arch clamp frame 1, small diameter portions 13*a* which protrude from at least one of both ends of the large diameter portion 13*b* and is eccentric with the large diameter portion 13*b* by the eccentricity e, and wherein the arch clamp foot lifting levers 12 are turnably supported by the small diameter portions 13*a*.

The arch clamp foot pressing device according to the third aspect of the invention is characterized in that the carrying unit 133 of the first aspect of the invention comprises a pin 301 attached to the through hole 1*e* of the arch clamp frame 1, the arch clamp foot lifting levers 302 which have through holes 302*c* formed of a long hole turnably and movably inserted into the pin 301, and an extension spring 303 which elastically biasing the arch clamp foot lifting levers 302 so that the tip end portions 302*b* of the arch clamp foot lifting levers 302 engage in the slots 5*a* of the arch clamp feet 5.

PREFERRED EMBODIMENT OF THE INVENTION

Figure 1:
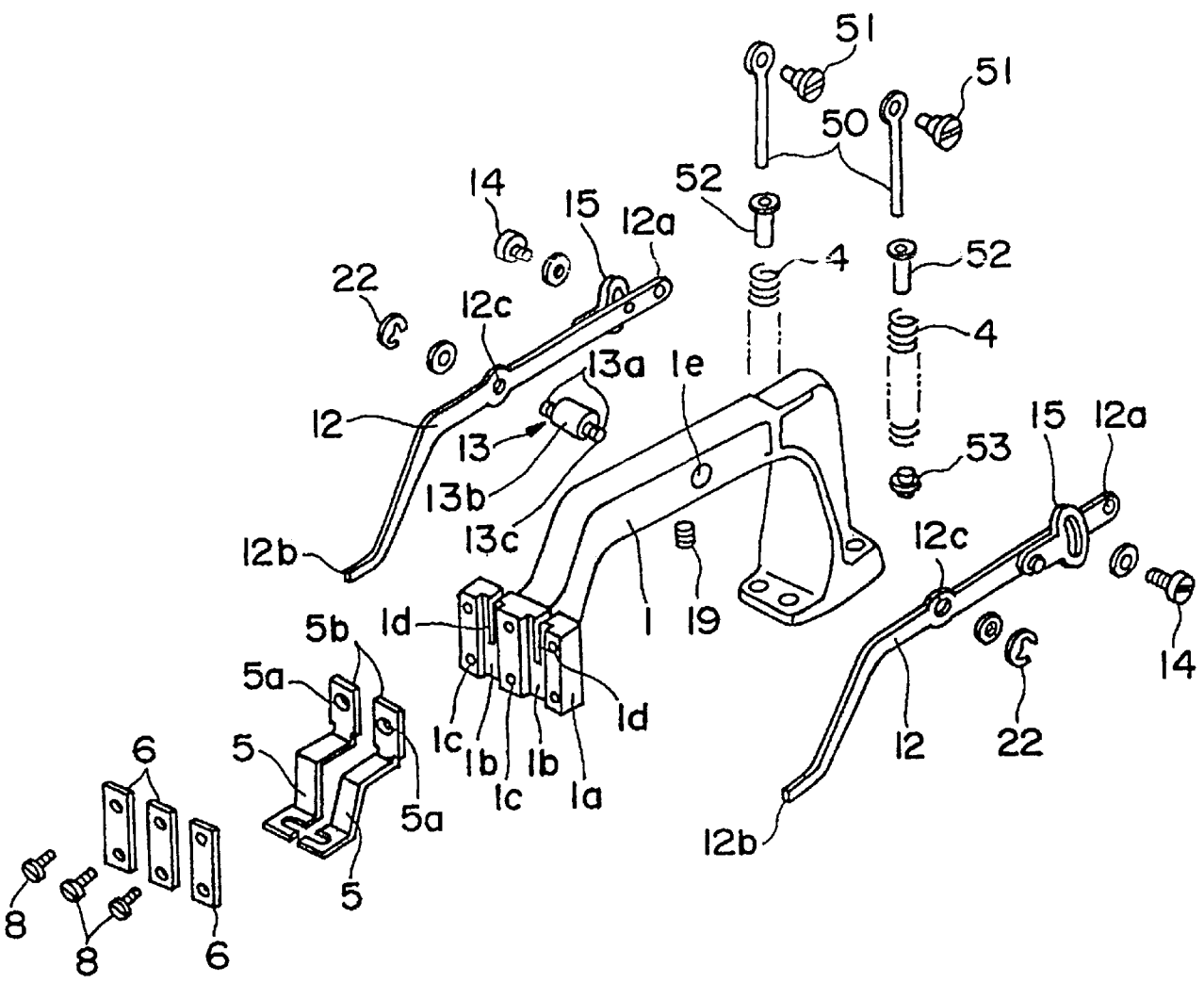
FIG. 1 is an exploded perspective view of an arch clamp foot pressing device according to a first embodiment of the invention.

First Embodiment (FIGS. 1 to 6):

A arch clamp foot pressing device which is applied to a bar tacking machine according to the first embodiment of the invention will be now described with reference to FIGS. 1 to 6.

The components which have same function as those of the conventional arch clamp foot pressing device are denoted by the same reference numerals and the explanation thereof is omitted.

First of all, the bar tacking machine is generally described with reference to FIG. 3. The workpiece clamping unit 30 having the arch clamp frame 1 is disposed on the upper surface of the bed 9, and the workpiece clamping unit driving mechanism 40 for driving the workpiece clamping unit 30 in given directions, back and forth (right and left in FIG. 3) and right and left (vertical direction relative to the paper surface in FIG. 3) is disposed in the bed 9, and the clamp lifting mechanism 17 for vertically driving the arch clamp feet 5 are disposed in the arm 16.

The operation of the bar tacking machine is the same as the conventional one. That is, when a solenoid of the solenoid actuator 34 is energized so that the plunger performs the entering operation so that the pressing member 18 lowers by way of the transmitting mechanism 37. Consequently, the projection 15, and hence the base end side of the arch clamp foot lifting lever 12 is pressed downward by the flange 18*a* of the pressing member 18 so that the arch clamp foot lifting lever 12 swings clockwise about the pin 13 against the resiliency of the compression spring 4. As a result, the arch clamp feet 5 moves upwards. When the arch clamp feet 5 moves upwards, the workpiece clamped between the arch clamp feet 5 and the feed plate 10 which are respectively integrally formed with arch clamp frame 1 is released.

On the other hand, if the solenoid of a solenoid actuator 34 is deenergized, the pressing member 18 moves upward by way of the transmitting mechanism 37. As a result, the flange 18*a* comes into contact with the lower surface of the guide bushing 36 attached to the arm 16 so that the pressing state of the projection 15 by the flange 18*a* is released. Consequently, the arch clamp foot lifting lever 12 which receives the resiliency of the compression spring 4 swings counterclockwise about the pin 13 to lower the arch clamp feet 5 so that the workpiece can be clamped between the arch clamp feet 5 and the feed plate 10.

When the arch clamp frame 1 of the workpiece clamping unit 30 and the feed plate 10 are moved in given directions, back and forth and right and left on the upper surface of the bed 9 by the workpiece clamping unit driving mechanism 40 in a state where the workpiece is clamped between the arch clamp feet 5 and the feed plate 10, the needle 41 can subject the workpiece to a given bar tacking.

Figure 6:
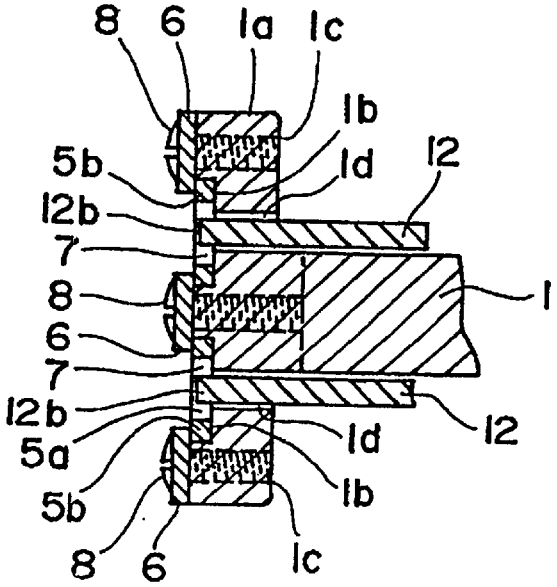
FIG. 6 is a sectional view taken along the line VI—VI in FIG. 3.

The arch clamp feet 5 are vertically movably attached to the tip end 1*a* of the arch clamp frame 1 as shown in FIGS. 1 and 6. The tip end 1*a* of the arch clamp frame 1 has the grooves 1*b* which are defined vertically in the tip end 1*a* at the surface thereof and the retaining plates 6 which retain the grooves 1*b* from the outside, and the guide portions 7 are defined in the grooves 1*b*. The guide portions 7 have shapes in the manner that U-shaped both ends are bent inward. Each of the upper end portions 5*b* of the arch clamp feet 5 can be inserted into the guide portions 7 to be movable upward and to be extracted. The tip end 1*a* of the arch clamp frame 1 also has slits 1*d* which are defined at the center of the grooves 1*b* so as to vertically receive the tip end portions 12*b* of the arch clamp foot lifting levers 12. There are formed the slits 1*d* and grooves 1*b* the number of which correspond to the number of the arch clamp foot lifting levers 12 and arch clamp feet 5, and there are formed respectively two portions in FIGS. 1 and 6. Meanwhile, when the retaining plates 6 are attached in the manner that the set screws 8 are screwed into screw holes 1*c* of the arch clamp frame 1 so as to be positioned at both sides of the grooves 1*b* as shown in FIG. 6, each wide upper end portions 5*b* of the arch clamp feet 5 can be vertically received by spaces having dovetail-like grooves (guide portions 7) which are partitioned by the grooves 1*b* and the retaining plates 6.

The arch clamp foot lifting levers 12 are turnably held by the arch clamp frame 1 at the middle portion through the pin 13 and it is always biased upward at the base end portions 12*a* thereof by the compression spring 4 serving as an compression spring which is compressed and interposed between the base end portions 12*a* and the arch clamp frame 1. Accordingly, the arch clamp foot lifting levers 12 are always biased counterclockwise about the pin 13 in FIG. 1 and 6. Guide shafts 50 are respectively swingably attached to the base end portions 12*a* of the arch clamp foot lifting levers 12 by hinge screws 51, and they are inserted into upper collars 52 which are inserted into and held by the upper end of the compression spring 4 formed of a coil spring, and the lower end of the compression spring 4 is supported by the arch clamp frame 1 by way of lower collars 53. As a result, the upper and lower ends of the compression spring 4 are respectively positioned.

The tip end portions 12*b* of the arch clamp foot lifting levers 12 can be engaged in or disengaged from the slots 5*a* defined in each of the upper end portions 5*b* of the arch clamp feet 5 in a state where it is vertically inserted in the slits 1*d* of the tip end 1*a* of the arch clamp frame 1, and the tip end portions 12*b* of the arch clamp foot lifting levers 12 elastically presses the arch clamp feet 5 downward by the resiliency of the compression spring 4 in the state where the tip end portions 12*b* of the arch clamp foot lifting levers 12 are engaged in the slots 5*a* of the arch clamp feet 5, so that the workpiece, not shown, can be clamped between the feed plate 10 and the arch clamp feet 5.

The projection 15 is fixedly mounted on the arch clamp foot lifting levers 12 by a set screw 14 in a state where it is adjusted in swinging position, and hence in protruding length thereof in a vertical direction, and it is positioned toward the base end rather than the pin 13. If the pressing member 18 is lowered by the clamp lifting mechanism 17, the projection 15 is pressed by the lower surface of flange 18*a* of the pressing member 18 so that the arch clamp foot lifting levers 12 turns clockwise to move the arch clamp feet 5 upward. The clamp lifting mechanism 17 is driven when the sewing operation starts or ends, and clamps the workpiece between the arch clamp feet 5 and feed plate 10 when the sewing operation starts and releases the clamping of the same when the sewing operation ends. Accordingly, the pressing member 18 moves upward and the flange 18*a* of the pressing member 18 comes in to contact with lower surface of the guide bushing 36 of the arm 16, so that a slight gap is defined between the flange 18*a* and the projection 15 in a state where the workpiece is clamped when the sewing operation is not performed.

The pin 13 will be now next explained. The pin 13 has large diameter portion 13*b* which is turnably received in the through hole 1*e* extending horizontally (right and left) at the middle portion of the arch clamp frame 1 as shown in FIG. 1, and small diameter portions 13*a* which are eccentric with the large diameter portion 13*b* by a given eccentricity e, and a slot 13*c* having a plus or minus shape is defined at least in one side of the small diameter portions 13*a*.

Figure 2:
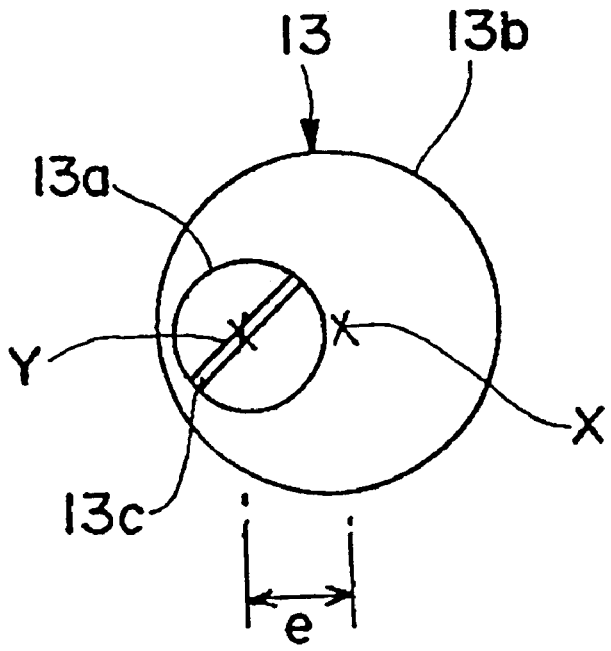
FIG. 2 is a view showing a pin of the arch clamp foot pressing device in FIG. 1.

That is, the pin 13 has the small diameter portions 13*a* which are received by through holes 12*c* of the arch clamp foot lifting levers 12 and have a central axis Y, and the central axis Y is eccentric by eccentricity e with the central axis X of the large diameter portion 13*b* to be engaged in the grooves 1*b* of the arch clamp frame 1 as shown in FIG. 2. The eccentricity e set in a manner that when the large diameter portion 13*b* is turned in the through hole 1*e* of the arch clamp frame 1, the tip end portions 12*b* of the arch clamp foot lifting levers 12 supported by the small diameter portions 13*a* are engaged in or disengaged from the slots 5*a* of the arch clamp feet 5. More in detail, the eccentricity e is set to about ½ relative to the thickness of the upper end portions 5*b* of the arch clamp feet 5 which are movable inside the grooves 1*b* of the arch clamp frame 1.

The pin 13 having such an arrangement is attached in a manner that a washer and an E-shaped fixed ring 22 are mounted on the small diameter portions 13*a* after the large diameter portion 13*b* is turnably received through the through hole 1*e* of the arch clamp frame 1 and small diameter portions 13*a* protruding from both sides of the arch clamp frame 1 are inserted into the through holes 12*c* of the arch clamp foot lifting levers 12, thereby preventing the arch clamp frame 1 from coming off. Further the pin 13 attached to the arch clamp frame 1 is fixed to the arch clamp frame 1 not to be turned when a set screw 19 is threaded. The pin 13 having the large diameter portion 13*b* which is turnably received by the through hole 1*e* of the arch clamp frame 1 and the small diameter portions 13*a* which protrude from the end of the large diameter portion 13*b* and are eccentric with the large diameter portion 13*b* by the eccentricity e, and by which the arch clamp foot lifting levers 12 are turnably supported constitutes the carrying unit 33 capable of moving the arch clamp foot lifting levers 12 in substantially horizontally along the axes connecting between the tip end portions 12*b* and the base end portions 12*a* of the arch clamp foot lifting levers 12 while it guides the arch clamp foot lifting levers 12.

Figure 5:
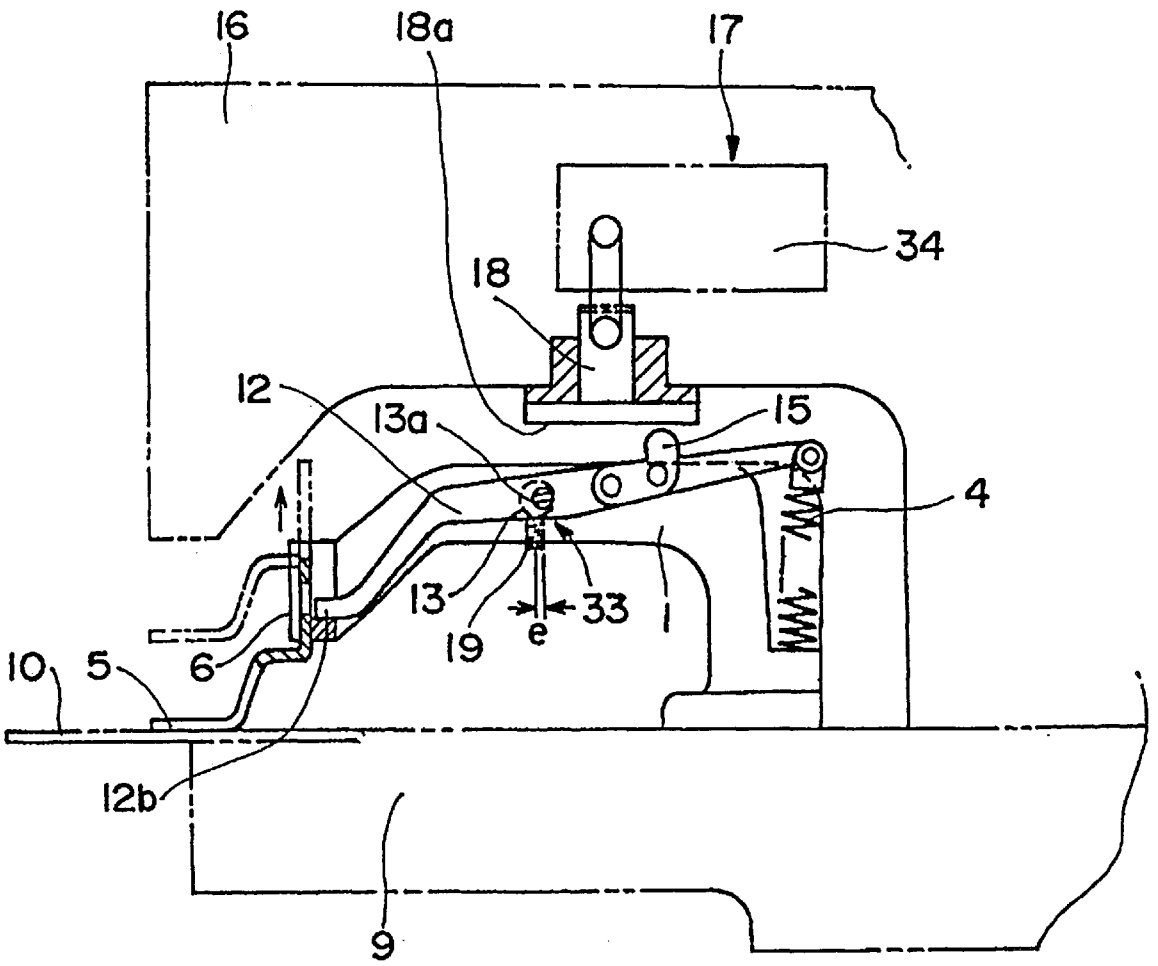
FIG. 5 is a view showing the operation of the arch clamp foot pressing device in FIG. 3.

Meanwhile when a screwdriver is engaged in the slot 13*c* defined in the end surface of the pin 13 and turned, the eccentric direction can be changed to the right and left. When the eccentric direction is moved to the left shown in FIG. 3, the tip end portions 12*b* of the arch clamp foot lifting levers 12 enters the slots 5*a* defined in the arch clamp feet 5, when the eccentric direction is moved to the right as shown in FIG. 5, the tip end portions 12*b* are extracted from the slots 5*a*. The slot 13*c* serves as an engaging portion for turning the pin 13 while it is engaged by an instrument such as a screwdriver, and it can be replaced with an engaging portion having a section except a circular shape. Meanwhile, such engaging portion may be formed on the flange which is formed tip end of the small diameter portions 13*a*, and it is coaxial with the large diameter portion 13*b*, thereby smoothly turning the pin 13.

The operation of the arch clamp foot pressing device according to the first embodiment of the invention will be next described with reference to FIGS. 3 to 5.

Figure 3:
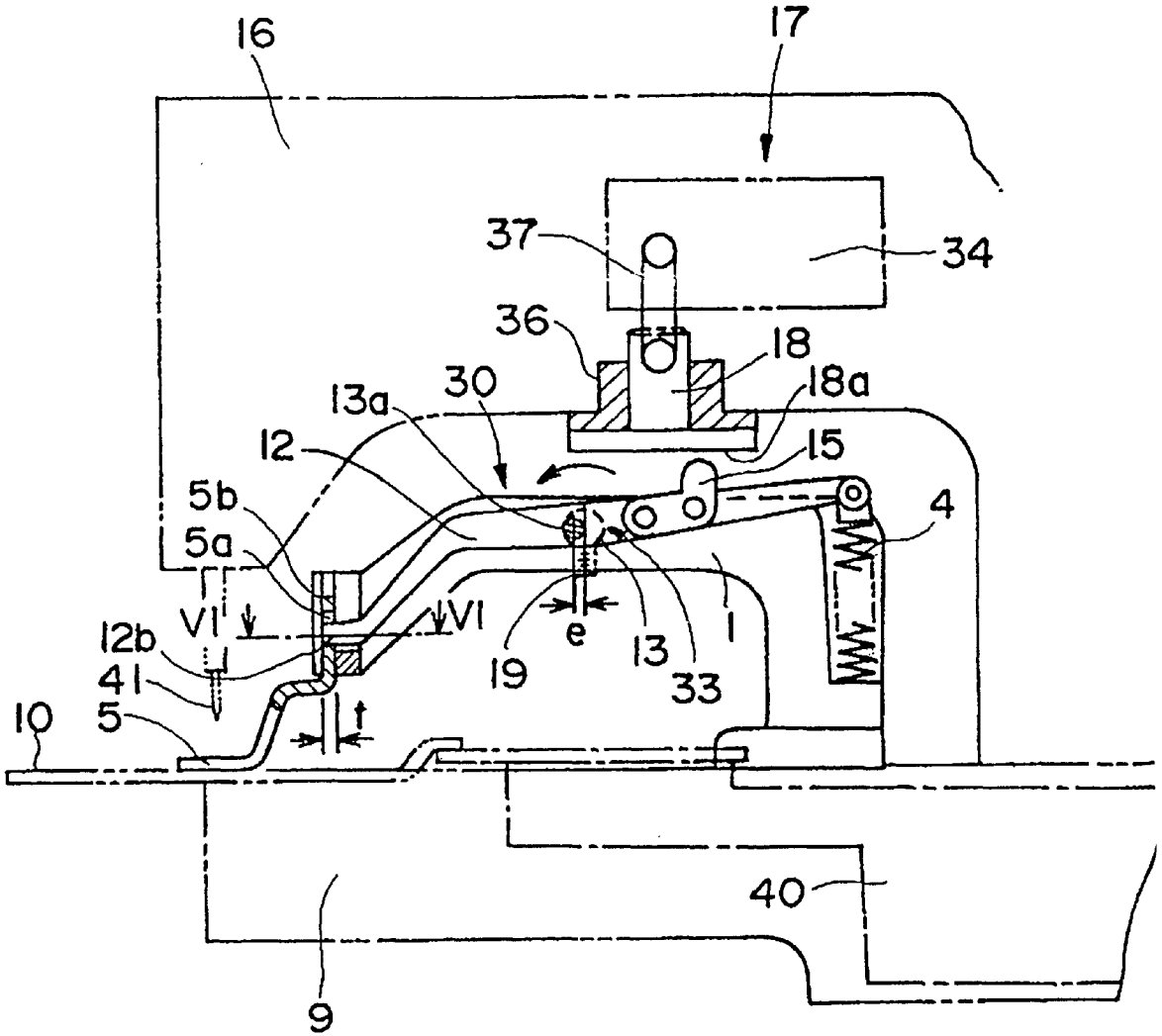
FIG. 3 is a schematic view of a bar tacking machine having the arch clamp foot pressing device in FIG. 1.

The pin 13, the arch clamp foot lifting levers 12, the arch clamp feet 5, the compression spring 4, the retaining plates 6, the set screw 19, etc. are assembled and incorporated with the arch clamp frame 1 as shown in FIG. 3 and it performs the sewing operation. In a state shown in FIG. 3, the tip end portions 12*b* of the arch clamp foot lifting levers 12 enter and engage with the slots 5*a* of the arch clamp feet 5, and the resiliency of the compression spring 4 acts upon the arch clamp feet 5 by way of the arch clamp foot lifting levers 12 to elastically lower the arch clamp feet 5 downward. The small diameter portions 13*a* of the pin 13 is positioned at the left end in FIG. 3, and the eccentricity e is positioned at the left side (tip end direction) of the central axis X of the large diameter portion 13*b*.

When the arch clamp feet 5 are replaced with other, the set screw 19 is loosened to release the pin 13 fixed to the arch clamp frame 1, then a screwdriver engages in the slot 13*c* of the pin 13 to turn the pin 13 clockwise in the through hole 1*e* of the arch clamp frame 1. As a result, the small diameter portions 13*a* of the pin 13 move to the upper right side while it turns about the central axis X of the large diameter portion 13*b*, and hence the arch clamp foot lifting levers 12 which engage with the small diameter portions 13*a* also moves upper right side. Accordingly, the projection 15 comes into contact with lower surface of the flange 18*a* of the pressing member 18 of the clamp lifting mechanism 17. When the arch clamp feet 5 are replaced with other, the projection 15 contacts the pressing member 18 to compress the compression spring 4 since the pressing member 18 is in an upward moving position, namely the flange 18*a* of the pressing member 18 comes into contact with lower surface of the guide bushing 36 when the sewing operation is not performed.

Figure 4:
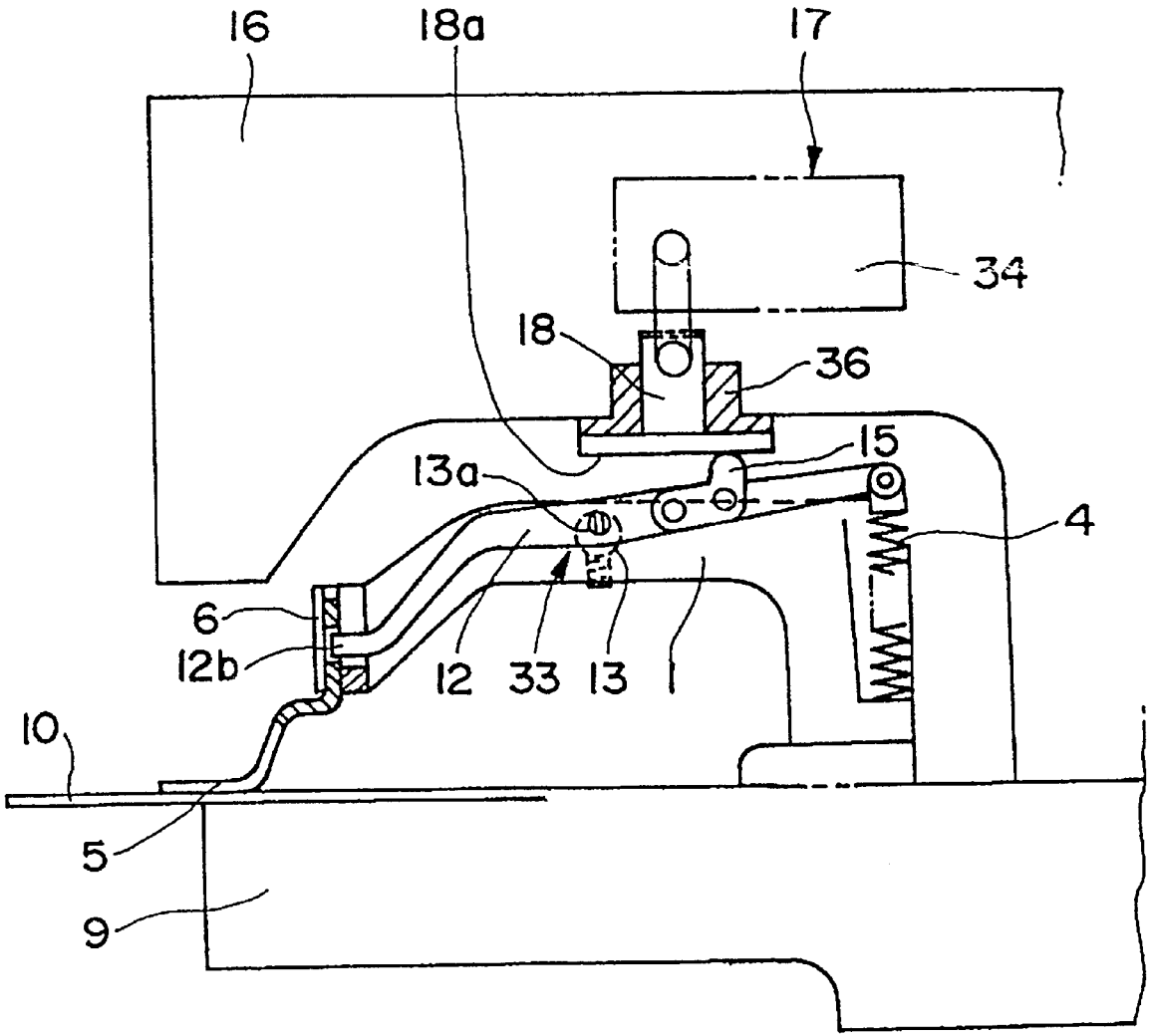
FIG. 4 is a view showing the operation of the arch clamp foot pressing device in FIG. 3.

Further, when the small diameter portions 13*a* reaches the upper end position while the pin 13 is turned clockwise, the tip end portions 12*b* of the arch clamp foot lifting levers 12 float over the arch clamp feet 5 to release the engagement between itself and the arch clamp feet 5 for pressing the arch clamp feet 5 downward, which is illustrated in the FIG. 4.

Subsequently, when the pin 13 is turned clockwise, the small diameter portions 13*a* are moved to the right while it is lowered, and also the arch clamp foot lifting levers 12 engaging with the small diameter portions 13*a* are also moved to the right. As a result, the small diameter portions 13*a* are moved to the right end in FIG. 5 so that the eccentricity e is positioned to the right side (base end direction) of the central axis X of the large diameter portion 13*b*. In such a manner, the pin 13 is turned about 180° until the small diameter portions 13*a* move from the left end to the right end so that the tip end portions 12*b* of the arch clamp foot lifting levers 12 are moved to the right by the amount twice the eccentricity e.

As a result, the tip end portions 12*b* of the arch clamp foot lifting levers 12 are disengaged from the slots 5*a*. This is caused by the setting of the tip end portions 12*b* in the manner that the tip end portions 12*b* of the arch clamp foot lifting levers 12 supported by the small diameter portions 13*a* are engaged in or disengaged from the slots 5*a* of the arch clamp feet 5 when the large diameter portion 13*b* is turned in the through hole 1*e* of the arch clamp frame 1. More in detail, the eccentricity e is set to be about half of the thickness t of the upper end portions 5*b* of the arch clamp feet 5 which move up and down in the grooves 1*b* of the arch clamp frame 1. Accordingly, when the pin 13 is turned about 180° so that the tip end portions 12*b* of the arch clamp foot lifting levers 12 are moved to the right by about twice the eccentricity e, the tip end portions 12*b* of the arch clamp foot lifting levers 12 are moved substantially horizontally to the right by the space corresponding to the thickness t of the upper end portions 5*b* of the arch clamp feet 5. When the tip end portions 12*b* of the arch clamp foot lifting levers 12 move horizontally, the tip end portions 12*b* of the arch clamp foot lifting levers 12 can be moved in positions where they are disengaged from the slots 5*a* of the arch clamp feet 5.

When the tip end portions 12*b* of the arch clamp foot lifting levers 12 are disengaged from the slots 5*a* of the arch clamp feet 5, the arch clamp feet 5 are extracted while they are slid upward inside the guide portions 7 (grooves 1*b*) of the arch clamp frame 1 and they are replaced with other.

When the new arch clamp feet 5 are inserted into the guide portions 7 of the arch clamp frame 1 from the upper portion thereof, the pin 13 is turned in the opposite direction, namely counterclockwise so that the tip end portions 12*b* of the arch clamp foot lifting levers 12 are engaged in the slots 5*a* of the arch clamp feet 5. Thereafter, when the pin 13 is secured to the arch clamp frame 1 by the set screw 19 to complete the replacing operation of the arch clamp feet 5.

Figure 7:
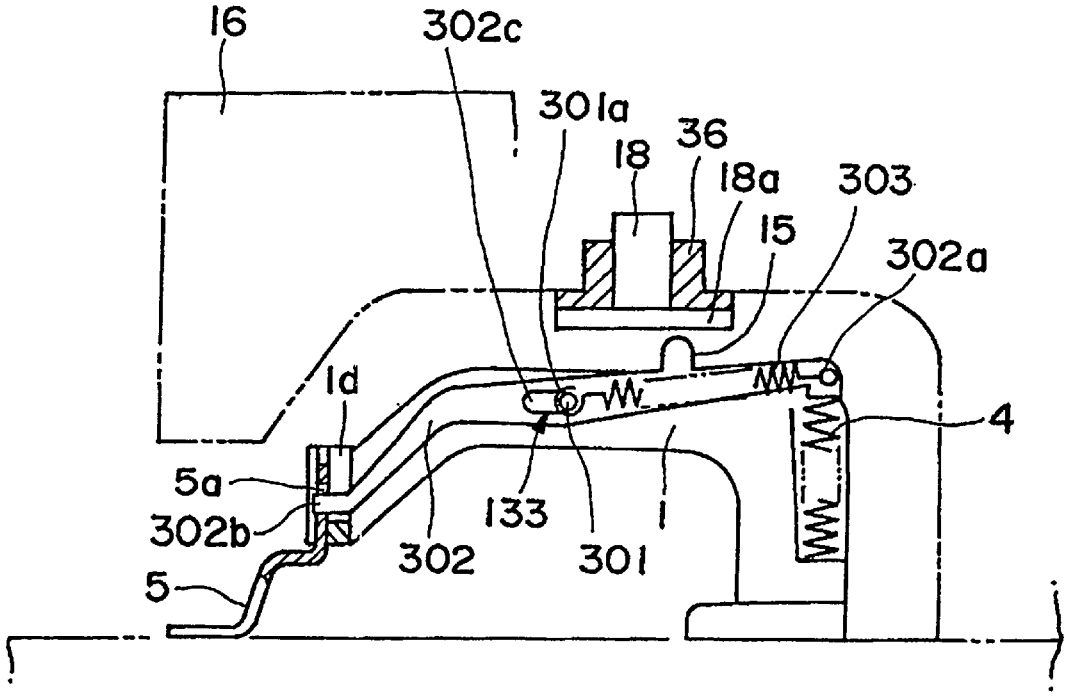
FIG. 7 is a schematic view of a bar tacking machine having the arch clamp foot pressing device according to a second embodiment of the invention.
Figure 8:
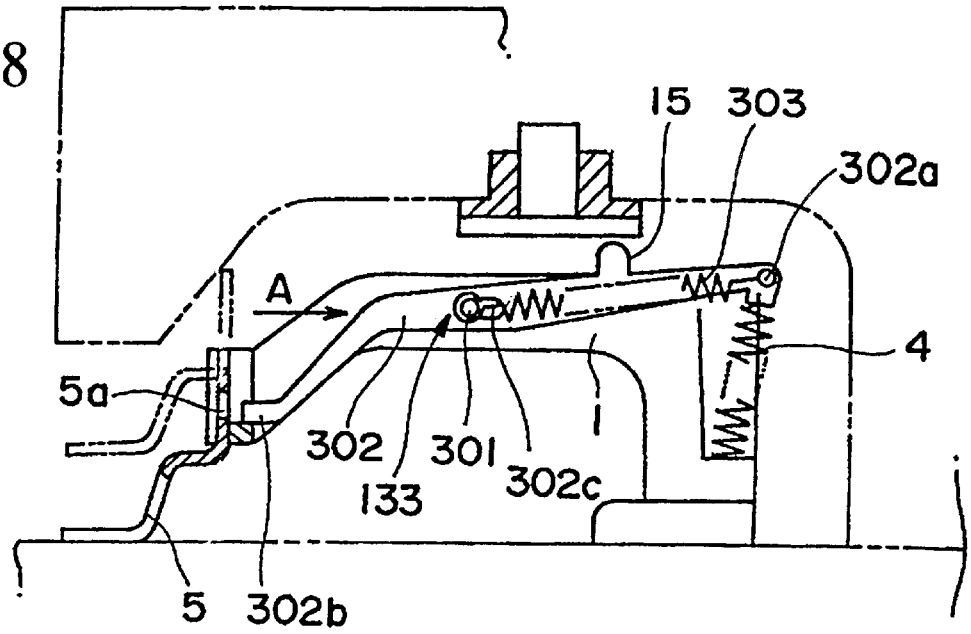
FIG. 8 is a view showing the operation of the arch clamp foot pressing device in FIG. 7.

Second Embodiment (FIGS. 7 and 8)

A arch clamp foot pressing device according to the second embodiment of the invention will be now described with reference to FIGS. 7 and 8.

The components which substantially have the same functions as those of the first embodiment are denoted by the same reference numerals, and the explanation thereof is omitted.

As shown in FIG. 7, middle portions of arch clamp foot lifting levers 302 are turnably supported by the arch clamp frame 1 through a pin 301 which is turnably received in through holes 302*c*. The pin 301 is different from the pin 13 in the first embodiment, and it has a portion attaching to the arch clamp frame 1 and another portion supported by the arch clamp foot lifting levers 302 which are respectively the same diameters but it is not necessary to be turned about the through hole 1*e* of the arch clamp frame 1. The through holes 302*c* have long holes which extend substantially horizontally along axes connecting between the base end portions 302*a* and the tip end portions 302*b*.

An extension spring 303 is extended between a hook portion 301*a* and base end portions 302*a* of the arch clamp foot lifting levers 302, and the tip end portions 302*b* of the arch clamp foot lifting levers 302 are always biased to be engaged in the slots 5*a* of the arch clamp feet 5 by the resiliency of the extension spring 303. Meanwhile, the arch clamp foot lifting levers 302 are directed and moved forward by the resiliency of the extension spring 303 and the pin 301 comes into contact with the base end of the through holes 302*c* in the state where the tip end portions 302*b* are engaged in the slots 5*a* of the arch clamp feet 5. The pin 301, which is attached to the through hole 1*e* of the arch clamp frame 1, the arch clamp foot lifting levers 302 having the through holes 302*c* formed of the long holes into which the pin 301 is turnably inserted, and the extension spring 303 which always elastically biases the arch clamp foot lifting levers 302 to permit the tip end portions 302*b* of the arch clamp foot lifting levers 302 to be engaged in the slots 5*a* of the arch clamp feet 5 form the carrying unit 133 which can be moved substantially horizontally along axes connecting between the base end portions 302*a* and the tip end portions 302*b* while it is guided by the pin 301.

In the arch clamp foot pressing device having such an arrangement, the replacement of the arch clamp feet 5 can be performed as follows. That is, the arch clamp foot lifting levers 302 are pushed backward against the resiliency of the extension spring 303 in the direction of an arrow A (base end direction) shown in FIG. 8, and the tip end portions 302*b* of the arch clamp foot lifting levers 302 are moved away from the engaging portion between itself and the slots 5*a* of the arch clamp feet 5. At that time, the arch clamp foot lifting levers 302 are moved to the base end while the pin 301 is moved relatively in the through holes 302*c*. It is needless to say that through holes 302*c* having the long hole are defined substantially horizontally in a manner that the tip end portions 302*b* of the arch clamp foot lifting levers 302 and the slots 5*a* of the arch clamp feet 5 can be engaged in or disengaged from each other.

Since the resiliency of the compression spring 4 acts upon the arch clamp feet 5 by way of the arch clamp foot lifting levers 302 in a state where the tip end portions 302*b* of the arch clamp foot lifting levers 302 are engaged in the slots 5*a* of the arch clamp feet 5, the arch clamp feet 5 are elastically pressed downward. The arch clamp feet 5 are released from the pressing state in a state where the tip end portions 302*b* of the arch clamp foot lifting levers 302 are disengaged from the slots 5*a* of the arch clamp feet 5. Even in the second embodiment, it has substantially the same function as the first embodiment when the arch clamp feet 5 are replaced with other.

Described now with reference to FIGS. 9 to 14 are first, second and third examples of construction of the pin 13 in the first embodiment, which is turned to move the arch clamp foot lifting levers 12, so that the arch clamp foot lifting levers 12 can be fixed or released, namely, engaged in or disengaged from the arch clamp feet 5 with one touch operation to expedite the replacement of the arch clamp feet 5.

The first example of the construction will be now described with reference to FIGS. 9 and 10.

That is, a flat portion 13*d* is formed on a part of the large diameter portion 13*b* of the pin 13, which is turnably received by the through hole 1*e* of the arch clamp frame 1. The flat portion 13*d* is formed on the upper end of the large diameter portion 13*b* in a state where the small diameter portions 13*a* of the pin 13 are positioned at the left end shown in FIGS. 2 and 3 and the eccentricity e is positioned at the left of the central axis X (tip end direction) of the large diameter portion 13*b* .

Figure 9:
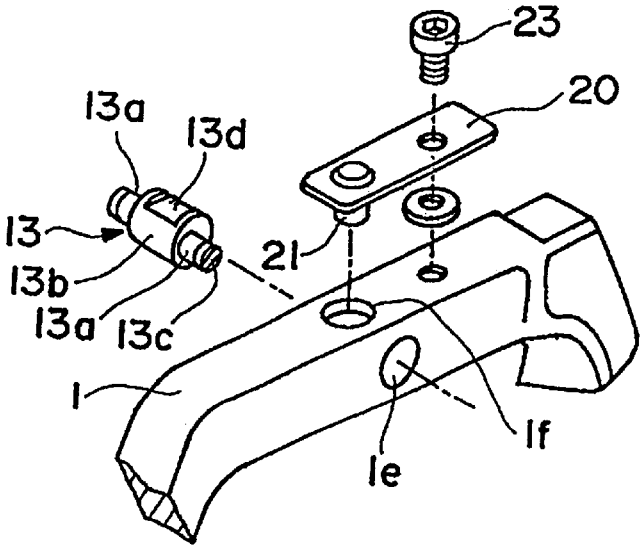
FIG. 9 is an exploded perspective view of a first example of construction capable of fixing and releasing the pin with one touch operation.
Figure 10:
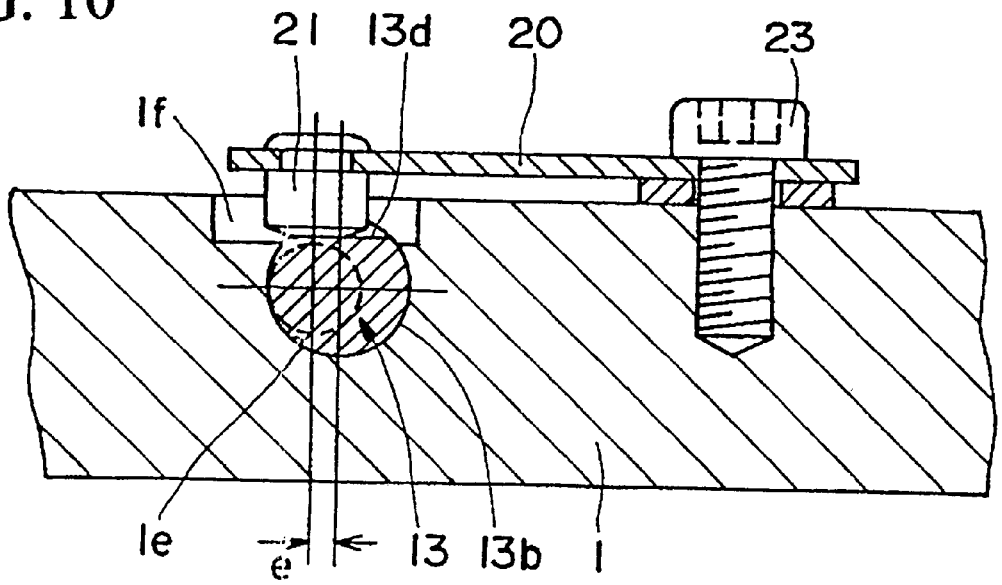
FIG. 10 is a sectional view of the first example of construction in FIG. 9.

An opening 1*f* is defined in the arch clamp frame 1 to perforate it from the above to cross at right angles with the through hole 1*e* and to reach the through hole 1*e* as shown in FIG. 9 and one end of a leaf spring 20 is secured to the upper surface of the arch clamp frame 1 by a set screw 23. A pressing piece 21 having a protruding shape is fixed to the other end of the leaf spring 20, and the pressing piece 21 enters the opening 1*f* so that it elastically contact the flat portion 13*d* of the pin 13 with surface contact. Since the set screw 19 for fixing the pin 13 is not necessary, it is omitted.

Meanwhile, when the pressing piece 21 elastically contacts the flat portion 13*d* of the pin 13 in a state where the tip end portions 12*b* of the arch clamp foot lifting levers 12 are engaged in the slots 5*a* of the arch clamp feet 5, the pin 13 is prevented from being disengaged from the slots 5*a* of the arch clamp foot lifting levers 12 when the pin 13 is turned inadvertently. On the other hand, when the arch clamp feet 5 are replaced with other, the pin 13 is turned in the through hole 1*e* so that the tip end portions 12*b* of the arch clamp foot lifting levers 12 can be easily disengaged from the slots 5*a* of the arch clamp feet 5. At this time, the leaf spring 20 is elastically deformed so that the pressing piece 21 is slightly lifted upward because the contact between itself and the large diameter portion 13*b* is changed to the contact between itself and the outer peripheral surface of the large diameter portion 13*b*. As a result, it is possible to omit the operation to loosen or fasten the set screw 19 compared with the first embodiment. As a result, the replacement of the arch clamp feet 5 in the first embodiment can be efficiently performed by moving the arch clamp foot lifting levers 12 with one touch operation.

Figure 11:
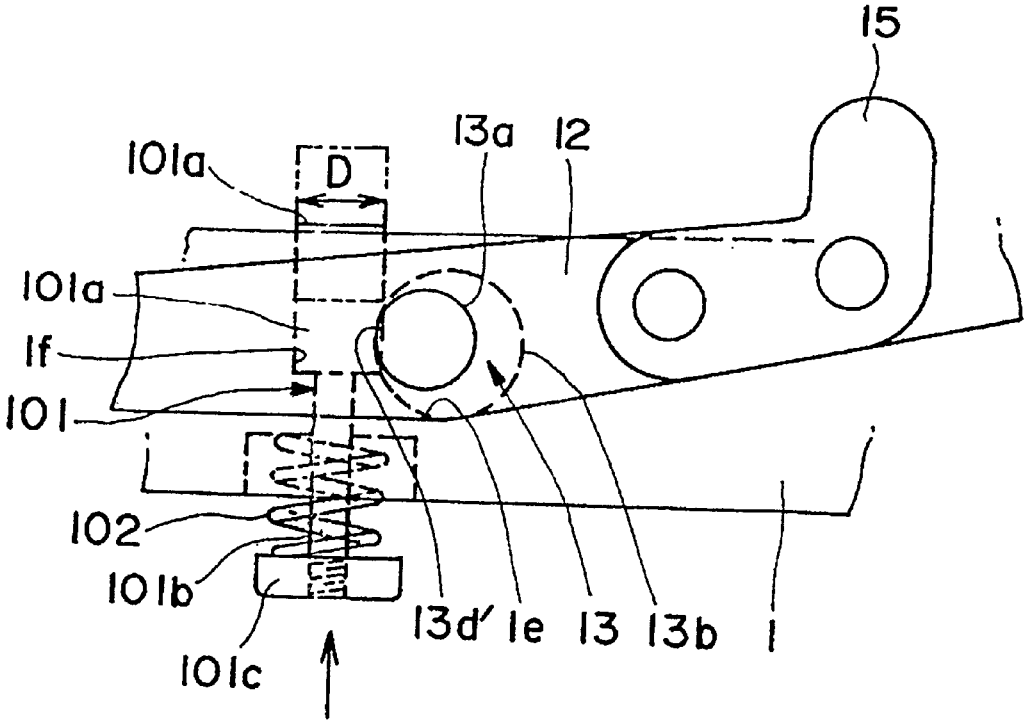
FIG. 11 is a view showing the operation of a second example of construction capable of fixing and releasing the pin with one touch operation.

The second example of the construction will be now described with reference to FIG. 11

The through hole 1*e* of the arch clamp frame 1 crosses at right angles in a space with the central axis of the stepped guide hole 1*f* of the arch clamp frame 1, and the through hole 1*e* communicates with the large diameter portion of the stepped guide hole 1*f* at a part thereof. A plunger 101 having a large diameter portion 101*a* of the diameter D and a small diameter portion 101*b* is slidably engaged in the stepped guide hole 1*f*.

Meanwhile, a flat portion 13*d*' is formed on a part of the large diameter portion 13*b* of the pin 13. The flat portion 13*d*' is formed in the left end in a state where the small diameter portions 13*a* of the pin 13 are positioned at the left end in FIGS. 2 and 3, and the eccentricity e is positioned at the left side (tip end direction) of the central axis X of the large diameter portion 13*b*. A flange portion 101*c* is formed on the tip end of the small diameter portion 101*b* of the plunger 101 protruding from the lower surface of the arch clamp frame 1, and an elastic spring 102 is interposed to be compressed between the lower surface of the arch clamp frame 1 and the flange portion 101*c*. Since the set screw 19 for fixing the pin 13 is unnecessary, it is omitted.

The plunger 101 lowers upon reception of the resiliency of the elastic spring 102 and the large diameter portion 101*a* retains on the stepped face of the stepped guide hole 1*f* in a state where the small diameter portions 13*a* of the pin 13 are positioned at the left end in FIGS. 2 and 3 and the eccentricity e is positioned at the left side (tip end direction) of the central axis X of the large diameter portion 13*b*. In a sate where the large diameter portion 101*a* retains on the stepped face of the stepped guide hole 1*f*, the outer peripheral surface of the large diameter portion 101*a* contacts the flat portion 13*d*' of the pin 13 to serve a wedge so as to prevent the pin 13 from turning. As a result, it is possible to prevent the tip end portions 12*b* from being disengaged from the slots 5*a* of the arch clamp feet 5 when the pin 13 is turned inadvertently in a state where the tip end portions 12*b* are engaged in the slots 5*a* of the arch clamp feet 5.

On the other hand, when the arch clamp feet 5 are replaced with other, the flange portion 101*c* of the plunger 101 is pushed into the stepped guide hole 1*f* by the finger tip against the resiliency of the elastic spring 102 so as to disengage the large diameter portion 101*a* from the flat portion 13*d*' of the pin 13 so that the pin 13 is turned in the through hole 1*e*. The turning of the large diameter portion 13*b* is allowed by the small diameter portion 101*b* of the pin 13. Accordingly, it is possible to easily disengage the tip end portions 12*b* of the arch clamp foot lifting levers 12 from the slots 5*a* of the arch clamp feet 5. As a result, it is possible to omit the operation to loosen or fasten the set screw 19 compared with the first embodiment, and the replacement of the arch clamp feet 5 in the first embodiment can be efficiently performed by moving the arch clamp foot lifting levers 12 with one touch operation after the plunger 101 is pushed into the stepped guide hole 1*f*.

The third example of the construction will be now described with reference to FIGS. 12 to 14.

That is, a flat portion 13*d*" is formed on a part of the large diameter portion 13*b* of the pin 13 which is turnably received by the through hole 1*e* of the arch clamp frame 1. The flat portion 13*d*" is formed in the left lower portion in a state where the small diameter portions 13*a* of the pin 13 are positioned at the left end in FIGS. 2 and 3, and the eccentricity e is positioned at the left side (tip end direction) of the central axis X of the large diameter portion 13*b* .

A clamp lever 201 is disposed to be adjacent to the pin 13 mounted on the arch clamp frame 1. The clamp lever 201 is turnably supported by the arch clamp frame 1 through a hinge pin 202. There are provided, around the hinge pin 202 of the clamp lever 201, a grip 201*a*, a first surface 201*b* capable of engaging with the flat portion 13*d*" of the pin 13, and a second surface 201*c* capable of opposing the large diameter portion 13*b* of the pin 13 with a slight gap. Since the set screw 19 for fixing the pin 13 is unnecessary, it is omitted.

Figure 12:
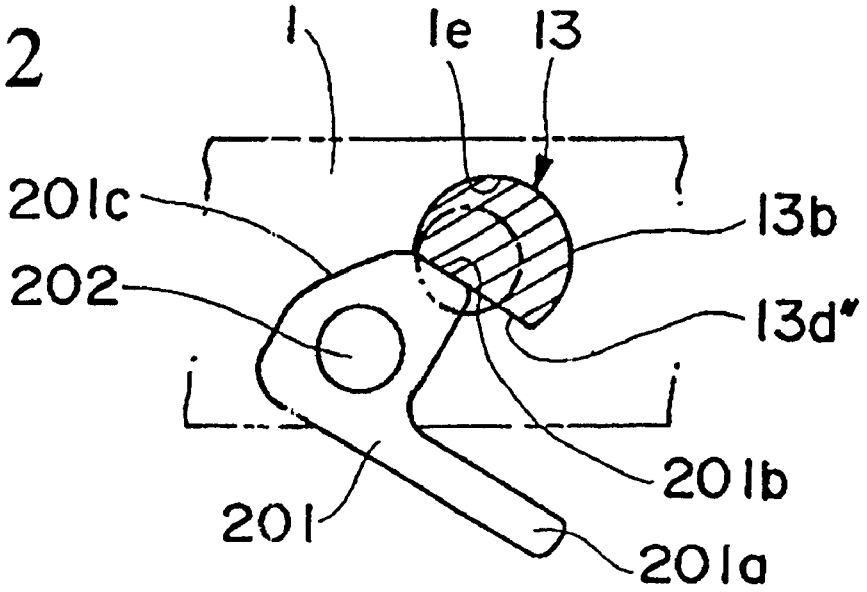
FIG. 12 is a view of a third example of construction capable of fixing and releasing the pin with one touch operation.

Meanwhile, in a state where the tip end portions 12*b* of the arch clamp foot lifting levers 12 are engaged in the slots 5*a* of the arch clamp feet 5, the grip 201*a* is gripped so as to turn the clamp lever 201 about the hinge pin 202 to allow the first surface 201*b* to be retained by the flat portion 13*d*" of the pin 13 as shown in FIG. 12, so that the tip end portions 12*b* are prevented from being disengaged from the slots 5*a* when the pin 13 is turned inadvertently.

Figure 13:
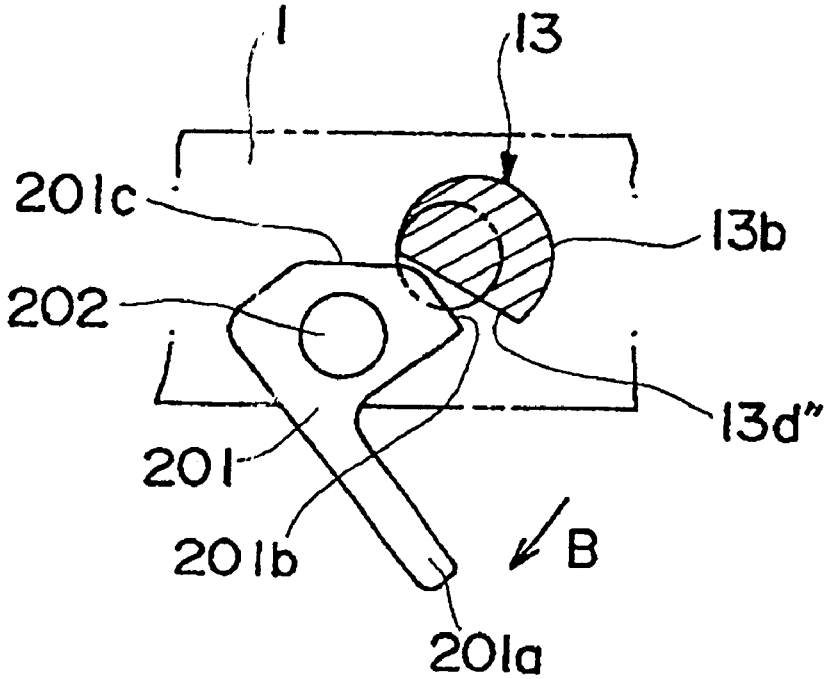
FIG. 13 is a view showing the operation of the construction in FIG. 12.
Figure 14:
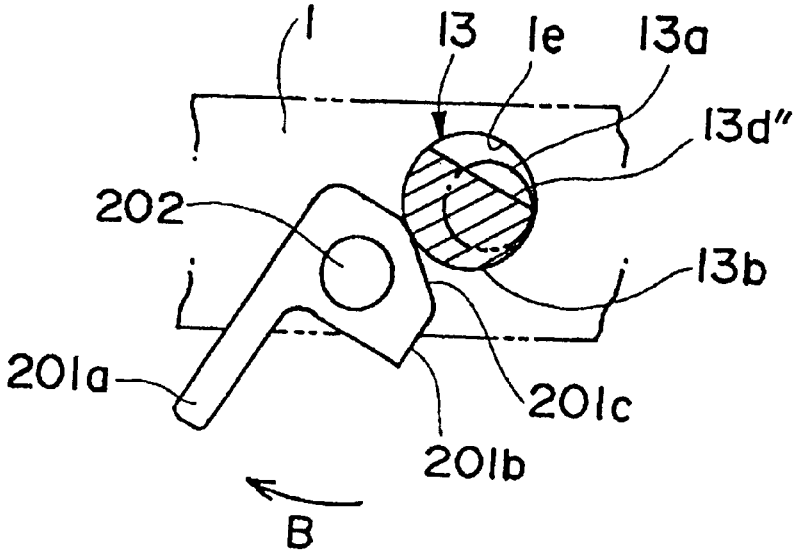
FIG. 14 is a view showing the operation of the construction in FIG. 12.
Figure 15:
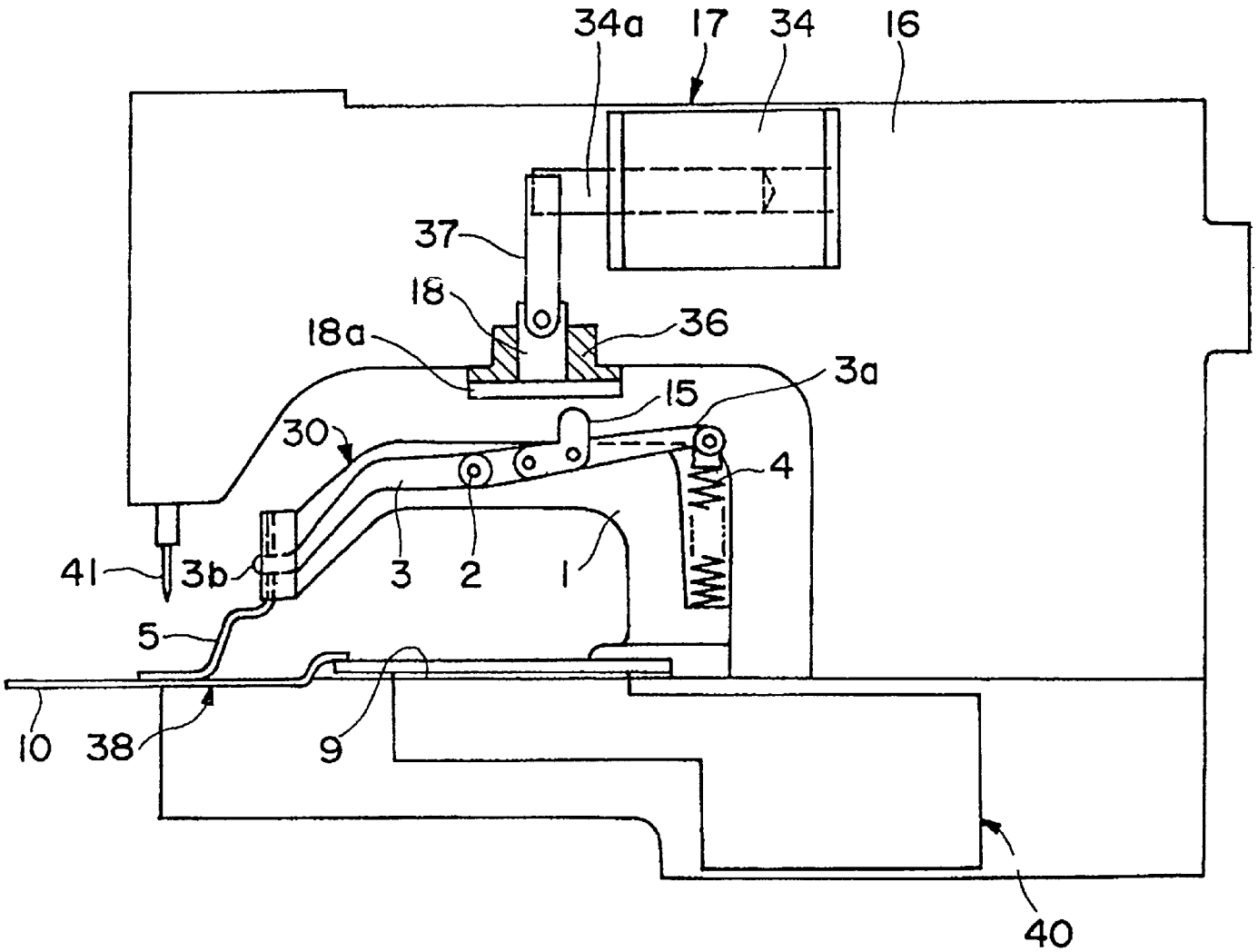
FIG. 15 is a schematic view of a bar tacking machine having a conventional arch clamp foot pressing device.

On the other hand, when the arch clamp feet 5 are replaced with other, the grip 201*a* is gripped so as to turn the clamp lever 201 in the direction of the arrow B to be loosened as shown in FIGS. 13 and 14, thereby allowing the second surface 201*c* to oppose the flat portion 13*d*" of the pin 13. As a result, the pin 13 can be turned in the through hole 1*e*. When the pin 13 is turned in the through hole 1*e*, the tip end portions 12*b* of the arch clamp foot lifting levers 12 can be easily disengaged from the slots 5*a* of the arch clamp feet 5. As a result, it is possible to omit the operation to loosen or fasten the set screw 19 compared with the first embodiment, and the replacement of the arch clamp feet 5 in the first embodiment can be efficiently performed by moving the arch clamp foot lifting levers 12 with one touch operation after the clamp lever 201 is turned.

Although the arch clamp foot lifting levers 12 or 302 are turnably supported by both ends of the pin 13 or 301 in the first and second embodiments, the present invention can be applied to the case where at least one of the arch clamp foot lifting levers 12 and 302 is turnably supported by the pin 13 or 301. Further, the present invention is not only applied to the bar tacking machine but also to a sewing machine capable of moving the feed plate 10 which is integrated with the arch clamp feet 5 and the arch clamp frame 1 back and forth and right and left on the bed 9.

As is understood from the above explanation, the clamp foot pressing device of the present invention has the following effects.

The first aspect of the invention includes the carrying unit (33, 133) which can move the arch clamp foot lifting levers 12 (12, 302) substantially horizontally along axes connecting between the tip end portions (12*b*, 302*b*) and the base end portions (12*a*, 302*a*) of the arch clamp foot lifting levers (12, 302) while it is guided by the pin (13, 301). Accordingly, the arch clamp foot lifting levers 12 can be moved easily and in a short time to a position where they are disengaged from the arch clamp feet 5, namely, to the position where the arch clamp feet 5 can be replaced with other.

Accordingly, it is possible to quickly cope with the change of the content of the sewing operation which needs the replacement of the arch clamp feet 5, thereby improving the rate of operation of the sewing machine. Further, since the construction of the present invention can be made exceedingly simple, it has a noticeable and useful practical effect such that the manufacturing cost is very low and it can be modified by slightly changing the parts of the conventional sewing machine.

What is claimed is:

1. A arch clamp foot pressing device comprising a bed, a arch clamp frame which moves in given directions, back and forth and right and left, at least one arch clamp foot attached to a tip end of the arch clamp frame to be movable up and down and to be extracted upward, arch clamp foot lifting levers which are provided corresponding to the arch clamp feet and have middle portions turnably supported by the arch clamp frame by a pin, base end portions biased upward by an upward biasing means, and tip end portions engageable in and disengageable from slots of the arch clamp feet and a feed plate which is integrated with the arch clamp frame, wherein the tip end portions of the arch clamp foot lifting levers elastically press the arch clamp feet downward owing to the biasing force of the upward biasing means while the tip end portions of the arch clamp foot lifting levers are engaged in the slots of the arch clamp feet to clamp a workpiece between the feed plate and the arch clamp feet, characterized in further comprising a carrying unit which can move the arch clamp foot lifting levers substantially horizontally along axes connecting between the tip end portions and the base end portions of the arch clamp foot lifting levers while it is guided by the pin, and wherein the tip end portions of the arch clamp foot lifting levers are disengaged from the slots of the arch clamp feet when the arch clamp foot lifting levers are moved by the carrying unit toward the base end portions, of the arch clamp foot lifting levers.

2. The arch clamp foot pressing device according to claim 1, wherein the carrying unit comprises the pin, and the pin comprises a large diameter portion which is turnably received in a through hole of the arch clamp frame, small diameter portions which protrude from at least one of both ends of the large diameter portion and is eccentric with the large diameter portion by eccentricity e, and wherein the arch clamp foot lifting levers are turnably supported by the small diameter portions.

3. The arch clamp foot pressing device according to claim 1, wherein the carrying unit comprises a pin attached to the through hole of the arch clamp frame, the arch clamp foot lifting levers which have through holes formed of long holes turnably and movably inserted into the pin, and an extension spring which elastically biases the arch clamp foot lifting levers so that the tip end portions of the arch clamp foot lifting levers engage in the slots of the arch clamp feet.

* * * * *